United States Patent [19]

Henrickson

[11] 4,316,288

[45] Feb. 23, 1982

[54] INVERTIBLE OUTERWEAR GARMENT

[76] Inventor: Mary J. Henrickson, 2839 Starbrook Dr., Charlotte, N.C. 28210

[21] Appl. No.: 194,005

[22] Filed: Oct. 6, 1980

[51] Int. Cl.[3] ..... A41D 3/08

[52] U.S. Cl. ..... 2/88; 2/84

[58] Field of Search ..... 3/88, 84, 74, 114, 105, 3/DIG. 7

[56] References Cited

U.S. PATENT DOCUMENTS 2,727,240 12/1955 Marshall ..... 2/50

FOREIGN PATENT DOCUMENTS 1022065 3/1966 United Kingdom ..... 2/88

*Primary Examiner*—Doris L. Troutman

*Attorney, Agent, or Firm*—John E. McGarry; Thomas L. Lockhart

[57] ABSTRACT

An article of clothing is disclosed for use as an outerwear garment (100). The garment comprises a planar integral portion (101) having a elliptical configuration. Invertible sleeves (113, 114) are attached at armholes (107, 106) in the integral portion at a position allowing for use as shawl-length outerwear and additionally for inverted use as floor-length outerwear.

9 Claims, 8 Drawing Figures

INVERTIBLE OUTERWEAR GARMENT

BACKGROUND OF THE INVENTION

1. Technical Field

This invention relates to articles of clothing and, more particularly, relates to outerwear fabric garments.

2. State of the Prior Art

Each year the fashion industry attempts to modify the "look" of women's styles. For example, dresses may vary in length, shape, neckline, and other characteristics. Outerwear may also have similar variances.

Several problems exist for the woman who wishes to maintain a current wardrobe. The cost of manufacturing clothing has substantially increased over the past few years. These increases are due both to labor and fabric costs. Accordingly, it is extremely difficult for many women to afford the cost of annually updating their wardrobes. Further, with respect to articles of clothing comprising outerwear, styles not only vary but a woman must have differing outerwear for various social occasions. For example, certain occasions may require a full-length coat while others may necessitate a more informal style such as a shawl- or street-length garment.

Certain outerwear fashions have maintained a substantially constant general style over the years. For example, on certain occasions, it is always been necessary for a woman to have a full-length outerwear garment. Additionally, on informal occasions such as outdoor sports events, outerwear garments comprising shawl-length "cape" designs remain acceptable.

The costs of manufacturing outerwear garments have increased not only due to increased rate costs but also due to the utilization of more intricate design patterns. The increased intricacy has led not only to higher fabric costs per garment but also has led to a greater amount of effective labor necessary for the manufacture of each garment.

The intricacy of design in various stylized fashions of outerwear garments has led to certain disadvantages. For example, certain of these garments are somewhat difficult to fold in a manner necessary for packing. Additionally, these designs have also made it difficult to press the garments and hang them thereafter. Other disadvantages include the fact that many of these garments are fitted in such a manner that if the user loses or gains even a minimal amount of weight, the garment can no longer be worn by the user. Of course, women in a pregnant state will find it impossible to utilize certain of their clothing during this period.

Other difficulties with many outerwear garments include a lack of warmth in critical areas such as the back and shoulder area because of a "single fabric" design in that area.

SUMMARY OF THE INVENTION

In accordance with the invention, an advantage is achieved in an invertible outerwear garment comprising a single integral portion wherein the garment can be worn in an inverted state to lengthen or shorten the style thereof.

The garment can be worn in such a manner that it affords a double warmth in the upper arm, back and shoulder area because of the double fabric design. Additionally, the design of the garment affords warmth in the neck area because of the folded shawl-like collar design. The upper portion of the garment can be utilized as a shawl or it can be utilized for head covering purposes.

Additionally, the design enables the garment to be utilized as a blanket-like covering for informal events such as football games or the like. The design of the garment allows modified "looks" which can be appropriate for any occasion from casual to formal situations.

The integral portion of the garment comprises armholes which can be utilized for purposes of attaching invertible sleeve portions thereto. The sleeve portions are attachable "off-center" on the integral portion of the garment. The integral portion of the garment can comprise a width and a length which is substantially less than the width. With the sleeves attached in an off-center position, the length of the integral portion comprises a short length portion and a long length portion. The sleeves are attached in a linear manner along a line extending from each side of the width portion such that the attachment positions of the sleeves to the integral portion are substantially equivalent distances from their respective edges.

DESCRIPTION OF THE DRAWINGS

The invention will now be described with reference to the drawings in which.

DETAILED DESCRIPTION

Figure 1:
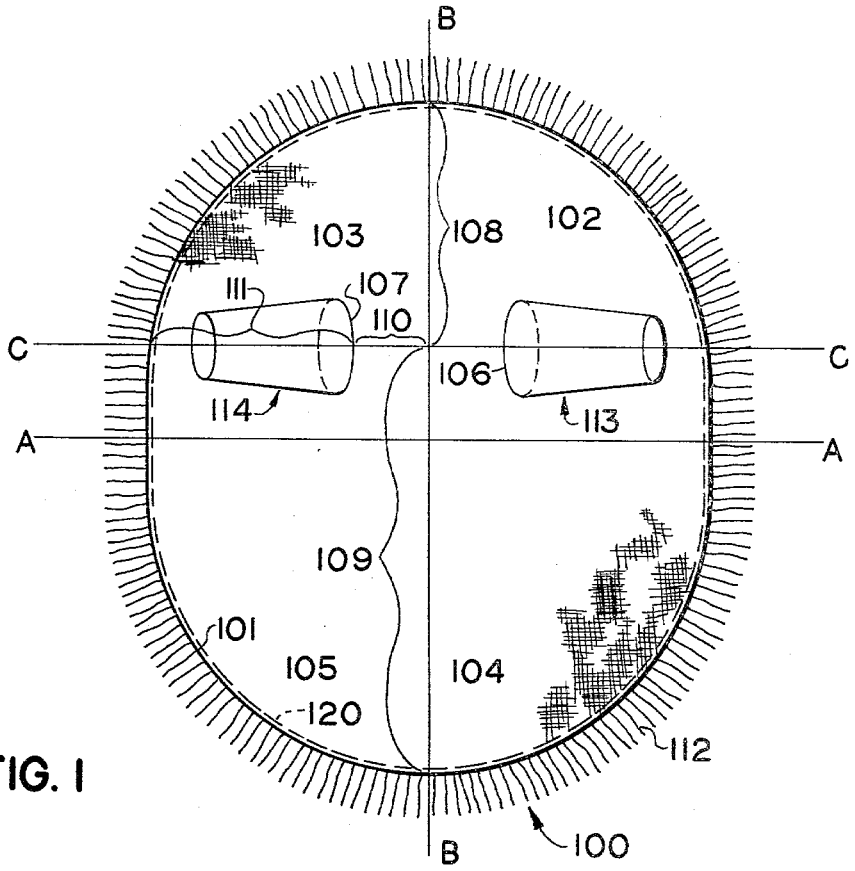
FIG. 1 shows a planar view of one illustrative embodiment of an invertible outerwear garment in accordance with the invention.

The principles of this invention are disclosed, by way of example, in an outerwear garment 100 as depicted in FIG. 1. Garment 100 comprises a portion of fabric 101 having a planar surface and an oval or elliptical shape. The fabric 101 preferably comprises a single integral fabric such as a wool blend or similar material and is finished on both sides thereof. If desired, two or more integral portions of fabric may be sewn together and may be of contrasting design or color. The use of a plurality of fabrics will correspondingly provide extra thickness to the garment 100 and, therefore, extra warmth for the user. The phantom line 120 inside of the circumference of the garment 101 is illustrative of the fabric 101 being seamed around its outer portions thereof. Preferably, the seam around the circumference of fabric 101 should be "turned under" at least twice.

To more clearly describe the structure of garment 100, it will be defined herein as having a width and a length wherein the minimum width of the garment extends along the axis A shown in FIG. 1. The maximum length of the garment extends along axis B also shown in FIG. 1 and which is perpendicular to axis A and bisects axis A at its midpoint along the width of the garment 100. Correspondingly, axis A is perpendicular to axis B and bisects axis B at its midpoint along the length of the garment 100. Accordingly, and as clearly shown in FIG. 1, the axes A and B divide the garment 100 into a quadrature structure with four quadrants therein. The quadrants are shown in FIG. 1 as upper quadrants 102, 103 and lower quadrants 104, 105. Quadrants 102 through 105 correspond to quadrants I through IV, respectively, as utilized in standard algebraic terminology.

In the illustrative embodiment described herein in accordance with the invention, the ratio of the maximum length of the garment to the minimum width is preferably about 9:7. Though this ratio can be varied, it is limited in range to about 9:7 in order to provide correct appearance and invertibility as subsequently described herein.

In upper quadrant 102, an armhole 106 is cut within the fabric portion 101. Correspondingly, a second armhole 107 is cut within the other upper quadrant 103. Each of armhole openings 106 and 107 are cut in a manner such that they are parallel to the axis B along the length of integral portion 101. Further, each of the openings 106 and 107 are substantially equidistant from axis B as shown in FIG. 1. Armholes 106 and 107 are cut such that axis C shown in FIG. 1 which is perpendicular to axis B and, accordingly, perpendicular also to the openings 106 and 107, bisects each of these openings substantially at their midpoints.

The length of the armholes 106 and 107 can be of any conventional length dependent on the size of the person who is to ulitize the garment. The specific position of armholes 106 and 107 with respect to the integral portion 101 is such that axis C, which is parallel to axis A, is above axis A and extends through quadrants 102 and 103. Axis C crosses axis B such that axis B is divided into an upper portion 108 and a lower portion 109 wherein the length of portion 108 is less than the length of portion 109. Preferably, the ratio of the length of portion 108 to the length of the portion 109 is about 1:2.

To further describe the position of armholes 106 and 107, FIG. 1 depicts the portion of axis C extending through quadrant 103 as comprising a length portion 110 between axis B and armhole 107, and a length portion 111 extending between armhole 107 and the circumferential edge of fabric portion 101 radially extending around quadrant 103. The length of portion 110 is less than the length of portion 111. Preferably, the ratio of the length of portion 110 to the length of portion 111 is about 3:5.

Figure 6:
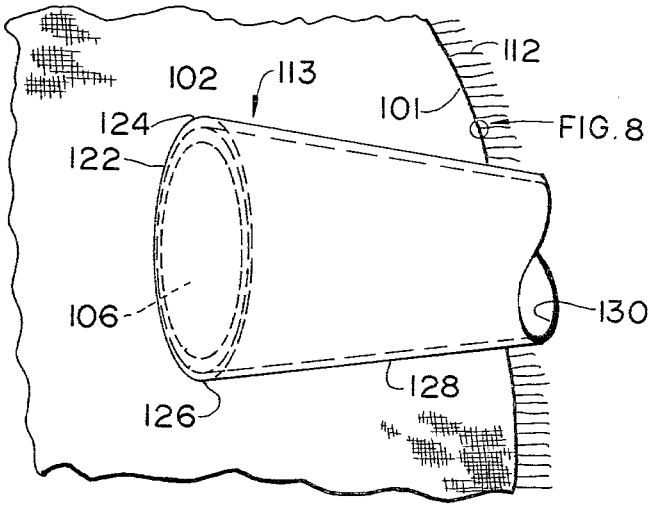
FIG. 6 is a detailed view of a sleeve of the outerwear garment shown in FIG. 1.

In accordance with the invention, sleeves 113 and 114 are attached to armholes 106 and 107, respectively. FIG. 6 is a partial cut away portion of garment 100 within quadrant 102 and is illustrative of the details of the sleeve 113. The garment 100 in FIG. 6 is shown in a partially undulated manner to illustrate the flexibility of the fabric surfaces shown therein. The sleeve 113 is conventionally known as a "Kimono" sleeve in that its appearance and construction is symmetric about an axis of rotation extending linearly through the sleeve at its central midpoint therein.

Figure 7:
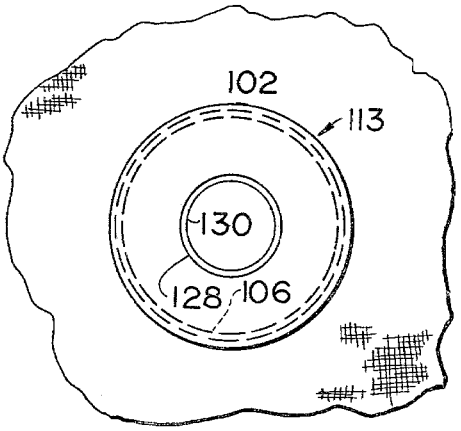
FIG. 7 is an end view of the sleeve shown in FIG. 6.

In accordance with the invention, the sleeve 113 is constructed to provide reversibility thereof. Sleeve 113 is sewn about the armhole slit 106 and is attached to the fabric 101 at seam 122 as shown in FIG. 6. The attached seam locations 124 and 126 shown in FIG. 6 are of a greater distance apart than the maximum opening of the armhole slit 106 in order to provide a seam "allowance" on both sides thereof. The extension of the sleeve 113 is provided by an integral portion of fabric 128 sewn to a second portion of sleeve fabric 130. Preferably, the length of the fabric portions 128 and 130 can be varied in accordance with the user's arm length and are tapered within a range of two to three inches from the attached locations 124 and 126 to the end of the sleeve. FIG. 7 depicts an end view of the sleeve 113 as it would appear extended outwardly and perpendicular to the view of FIG. 7. Preferably, the distance between attachment locations 124 and 126 is about eight inches while the diameter of the sleeve 113 at its extended end position is about five inches.

Figure 8:
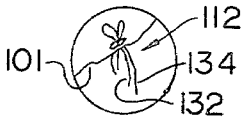
FIG. 8 is a detailed view of the fringe of the outerwear garment shown in FIG. 1.

To enhance the aesthetics of garment 100, fringes 112 or similar decorative materials can be attached in a conventional manner to the perimeter of integral portion 101 as shown in FIG. 1. FIG. 8 depicts an enlarged singular fringe 112 from the drawing of FIG. 6. As shown in FIG. 8, a single fringe 112 comprises two strands 132 and 134, each knotted and sewn into the fabric portion 101. Preferably, the strands 132 and 134 are of different lengths to provide a "fuller" appearance to the fringes 112 of garment 100.

Figure 2:
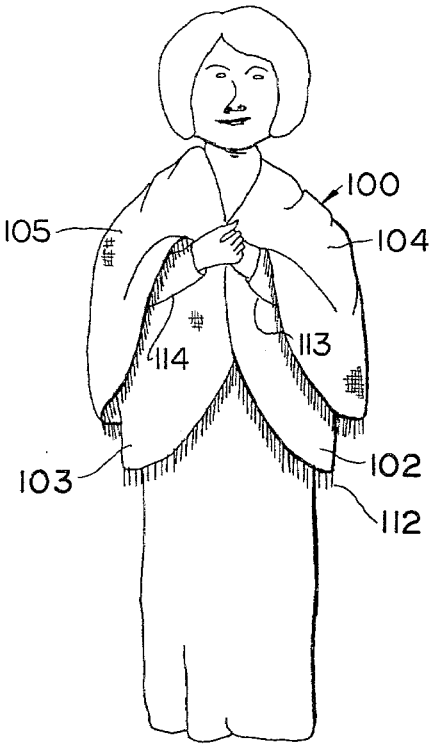
FIG. 2 is a perspective view showing a wear arrangement of the outerwear garment shown in FIG. 1.
Figure 4:
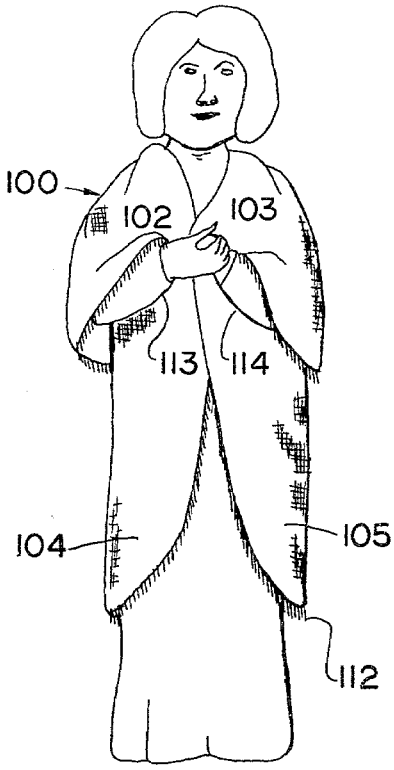
FIG. 4 is a perspective view of a still further wear arrangement.
Figure 3:
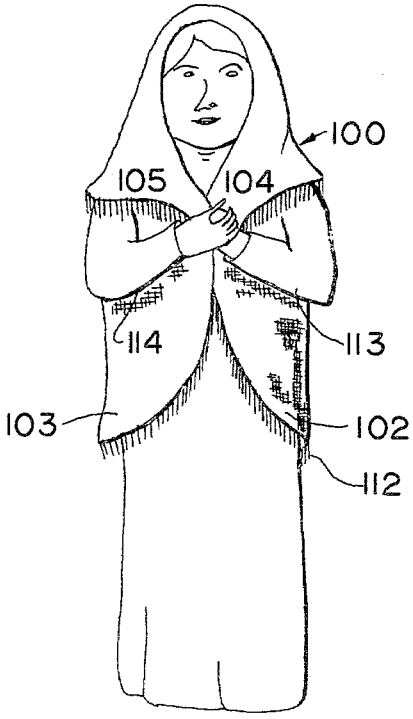
FIG. 3 is a perspective view of a differing wear arrangement for the outerwear garment shown in FIG. 1.

Turning to the utilization of garment 100, FIGS. 2 through 4 depict a user "wearing" garment 100 in its various modes and in accordance with the invention. In general, the garment 100 can be worn with either its upper portion comprising quadrants 102 and 103 or its lower portion comprising quadrants 104 and 105 as the bottom of the garment. With the armholes 106 and 107 positioned such that the length of the portion 108 along axis B is shorter than the length of the portion 109 along axis B, inversion of the garment 100 will provide the user with either a full-length or "long" garment, or a short or "street-length" garment.

As depicted in FIG. 2, the user is utilizing garment 100 as a "short" garment. When utilizing the garment 100 in this manner, the quadrants 102 and 103 appear at the bottom of the garment as depicted in FIG. 2. Correspondingly, quadrants 104 and 105 appear at the upper part of the garment along the shoulders and back of the user. It should be noted that the integral portion 101 comprising quadrants 104 and 105 are actually the opposite surfaces of quadrants 104 and 105 visible in FIG. 1. Further, it should also be noted that with the use of the garment as shown in FIG. 2, there is a double layer of fabric across the back and shoulders of the user, thereby supplying substantial warmth thereto.

FIG. 3 depicts the user wearing garment 100 again with the upper quadrants 102 and 103 at the bottom of the garment. However, the user has now utilized the lower quadrant portions 104 and 105 as a hood to cover the head. Accordingly, garment 100 can now be worn in a "shawl-like" manner.

FIG. 4 depicts the invertible use of garment 100 as a long or full-length garment. As shown in FIG. 4, the garment is worn such that the lower quadrants 104 and 105 now comprise the bottom of the garment. Correspondingly, the upper quadrants 102 and 103 now are worn along the back and shoulders of the user. It should be noted that the surfaces of quadrants 104 and 105 visible to the viewer in FIG. 4 are actually the opposite surfaces of quadrants 104 and 105 depicted in FIG. 1. Again, the user has a double layer of fabric across the back and shoulders for provisions of warmth.

Figure 5:
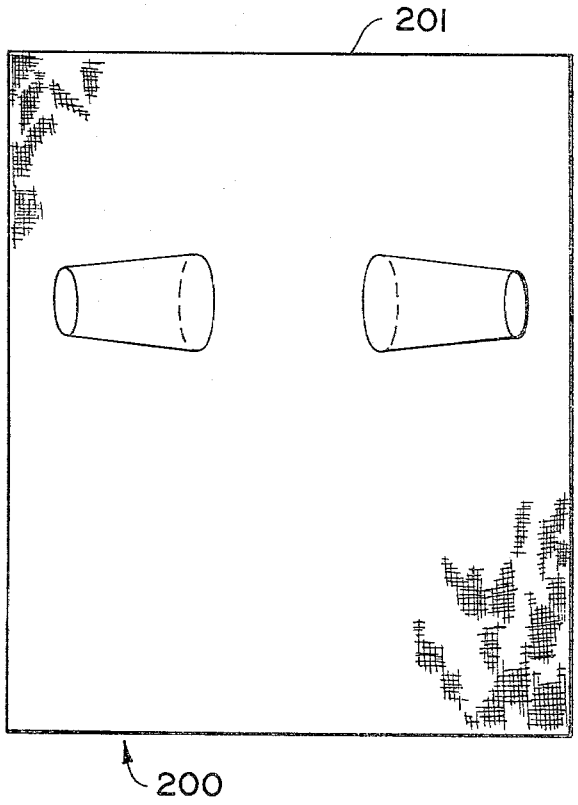
FIG. 5 is a planar view of another illustrative embodiment of an outerwear garment in accordance with the invention.

FIG. 5 depicts a further illustrative embodiment of an outerwear garment 200 in accordance with the invention. Garment 200 corresponds substantially to the previously described garment 100 but, rather than having an oval or elliptical shape as garment 100, the garment 200 comprises a rectangular integral portion 201. Armholes 202 and 203 are cut in integral portion 201 and correspond in position and function to armholes 106 and 107, respectively, as described with respect to FIG. 1.

The principles of the invention are not limited to the specific outerwear garments described herein. It will be apparent to those skilled in the art that modifications and variations of the above described illustrative embodiments of the inventions may be effected without departing from the spirit and scope of the novel concepts of the invention.

The embodiments of the invention in which an exclusive property or privilege is claimed are defined as follows:

1. An article of clothing adapted for use as an outerwear garment and comprising:

a fabric portion of generally elliptical shape and having a length along a first axis greater than a length along a second axis, said fabric being symmetrical about said first and said second axis, whereby said fabric portion is divided into four imaginary quadrants of substantially equal areas comprising first, second, third, and fourth quadrants by said axes;

first and second armholes through said fabric, said first armhole being completely within said first quadrant, and said second armhole being completely within said second quadrant; and said first and second armholes are equidistant from said first axis and are positioned within said first and said second quadrants, respectively, to provide a user with a full-length outerwear garment with said garment worn in a first manner such that said third and said fourth quadrants are positioned at the bottom of said garment, and to further provide said user with a shorter length outerwear garment with said garment worn in a reversed manner from said first manner and with said first and said second quadrants being positioned at the bottom of said garment.

2. An outerwear garment in accordance with claim 1 characterized in that the ratio of the length of the garment along said first axis to the length of the garment along said second axis is about 9:7.

3. An outerwear garment in accordance with claim 1 characterized in that the ratio of the distance of the midpoint of either of said first or said second armholes from the circumferential edge of the fabric portion on said first axis extending between said third and said fourth quadrants to the distance of the midpoint of either of said first or said second armholes from the circumferential edge of the fabric portion on said first axis between said first and said second quadrants is about 2:1.

4. An outerwear garment in accordance with claim 1 characterized in that the ratio of the distance between said first armhole and said first axis to the distance between said first armhole and a circumferential edge of said fabric portion along an axis parallel to said second axis is about 3:5.

5. An outerwear garment in accordance with claim 1 characterized in that said garment further comprises fringes attached to and extending from the circumferential edge of said fabric portion, wherein each of said fringes comprises a pair of strands attached to said fabric portion, each of said strands being cut to a different length.

6. An outerwear garment in accordance with claim 1 characterized in that the position of said first and said second armholes, respectively, in said first and said second quadrants of said fabric portion allows the user to wear the garment with said fabric portion covering said user's head.

7. An outerwear garment in accordance with claim 1 characterized in that said outerwear garment further comprises first and second reversible sleeves attached to said fabric portion and to said first and second armholes, respectively.

8. An outerwear garment in accordance with claim 7 characterized in that each of said first and said second reversible sleeves is tapered between its respective attachment to said first and said second armholes and the end portions thereof.

9. An outerwear garment in accordance with claim 1 characterized in that both said first and second armholes are parallel to said first axis.

* * * * *